United States Patent [19]

Wallace

[11] 4,179,983

[45] Dec. 25, 1979

[54] HYDRAULIC PERCUSSIVE MACHINES

[75] Inventor: Trevor E. Wallace, Bryanston, South Africa

[73] Assignee: The Steel Engineering Company Limited, Roodepoort, South Africa

[21] Appl. No.: 775,992

[22] Filed: Mar. 9, 1977

[30] Foreign Application Priority Data

Mar. 17, 1976 [ZA] South Africa ..... 76/1650

[51] Int. Cl.[2] ..... F01B 11/02

[52] U.S. Cl. ..... 92/85 B; 91/394; 173/134

[58] Field of Search ..... 92/85 B; 173/134, DIG. 4; 91/321, 300, 325, 394

[56] References Cited

U.S. PATENT DOCUMENTS

| | | | |
|---|---|---|---|
| 328,730 | 10/1885 | Thoens | 91/401 |
| 2,248,546 | 7/1941 | Morrison et al. | 91/321 X |
| 3,596,562 | 8/1971 | Foster et al. | 92/85 B |
| 3,701,386 | 10/1972 | Feucht | 173/134 X |
| 3,774,502 | 11/1973 | Arndt | 91/321 X |
| 3,887,019 | 6/1975 | Reynolds et al. | 92/85 B |
| 3,990,351 | 11/1976 | Sundin | 92/85 B |

FOREIGN PATENT DOCUMENTS

| | | | |
|---|---|---|---|
| 115760 | 9/1924 | Fed. Rep. of Germany | 91/325 |

*Primary Examiner*—Irwin C. Cohen
*Attorney, Agent, or Firm*—Young & Thompson

[57] ABSTRACT

A hydraulic percussive machine in which a piston is caused to reciprocate in a cylinder including a cushioning flange on the piston, a first space in which the flange normally moves, a second space into which the flange can move on overtravel of the piston during the power stroke to trap fluid into the second space so that a dashpot action takes place, and co-operating timing grooves and ports on the piston and the cylinder to connect the first space to a low pressure zone in the system.

4 Claims, 1 Drawing Figure

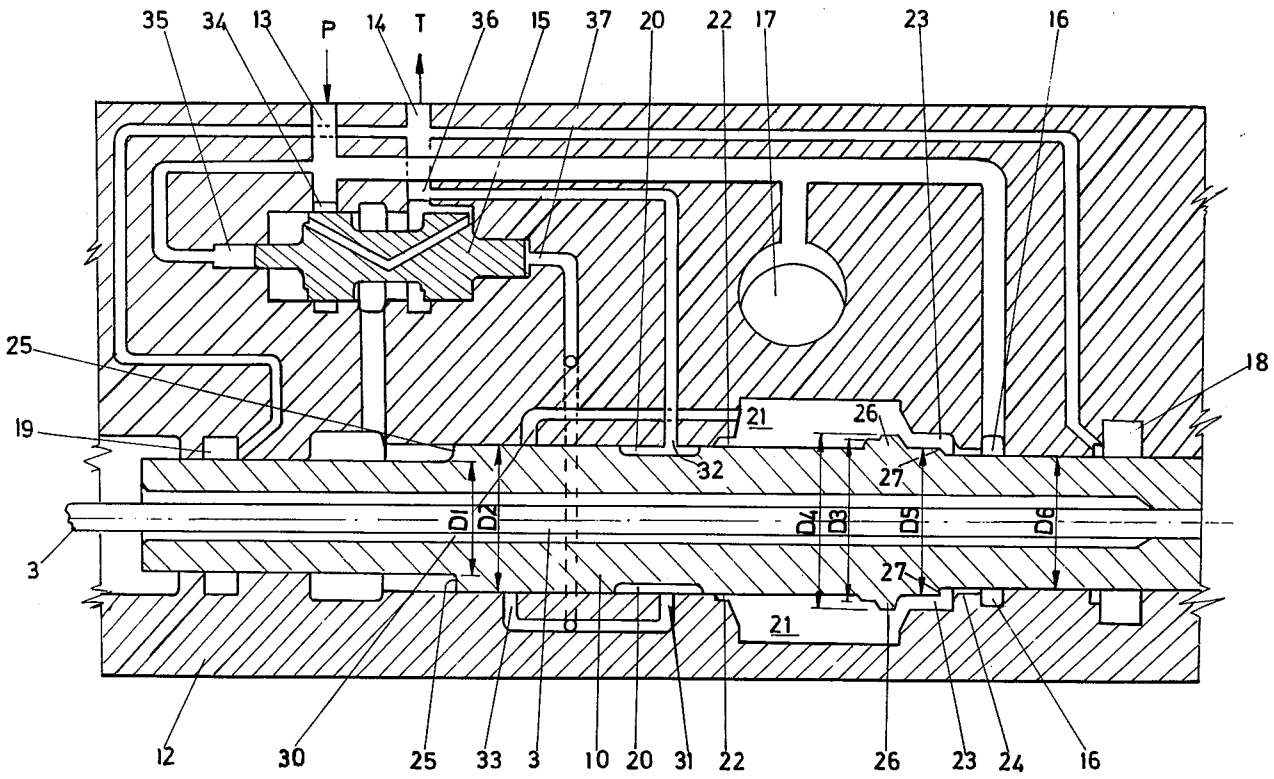
18
16
23
17
22
20
37
15
36
T
14
P
13
34
35
25
19
3
12
30
25
33
3
10
20
31
22
21
32
21
26
27
27
26
24
16
D6
D5
D4
D3
D2
D1

HYDRAULIC PERCUSSIVE MACHINES

This invention relates to hydraulic percussive machines of the kind which are suitable for use as rock drilling machines and the like.

Of recent years a variety of hydraulic machines have been proposed to replace pneumatic rock drilling machines. A number of these have one feature in common: they do not use the large piston head of a pneumatic machine and the operating piston is provided with differential operating areas in which the return stroke area is smaller than the forward stroke or power stroke area. As a result the return stroke area may be left connected to the hydraulic supply line at all times while the valve system alternately connects the power stroke area to the hydraulic supply line and to tank. The power stroke may be assisted by discharging an accumulator which is charged during the return stroke.

In these machines it has been found that under no load conditions, e.g. when the machine is withdrawn from a drill stem, and with the hydraulic supply connected, the piston may overtravel and stall. In order to prevent this, it has been proposed (see for example the complete specification of S.A. Patent No. 74/5601) to provide a flange on the piston which moves into a space from which a controlled leak of fluid takes place so that a cushion of fluid in the space arrests the piston before it can reach the end of its travel. In the abovementioned complete specification part of the flange also provides the piston area for the return stroke. Once the piston enters that space reversal is only possible by means of a leak back into the space of fluid at the supply pressure and while the flange is in the space, fluid from behind at the supply pressure resists its return from the space. Smooth operation under no load conditions is therefore not easily achieved.

In another proposal a timing land on the piston is used as a cushioning flange. This land is spaced from a shoulder providing the return stroke area. In this case one cannot easily vary the cushioning area.

According to the invention a hydraulic percussion machine in which a piston is caused to reciprocate in a cylinder includes a cushioning flange on the piston, a first space in which the flange normally moves, a second space into which the flange can move on overtravel of the piston during the power stroke to trap fluid into the second space so that a dashpot action takes place, and co-operating timing grooves and ports on the piston and the cylinder to connect the first space to a low pressure zone in the system. This connection may be designed to occur either when the flange is in or approaches the second space.

Further according to the invention the piston is provided with a shoulder on the forward end of the piston in relation to the cushioning flange to provide a return stroke area, the shoulder closing the forward end of the second space and a port adapted to be connected to a source of fluid under pressure at the mouth of that end.

Also according to the invention the rear of the cushioning flange is stepped to provide a shoulder and in which the cylinder is provided with a third space which the stepped portion can enter during overtravel on the return stroke.

The invention is further discussed with reference to the accompanying drawing, which is a section through a rock drilling machine according to the invention.

In the drawing a piston 10 with an axial water tube 3 is illustrated, but for some drilling operations and for pavement breakers the water tube need not be present. The piston 10 operates in a cylinder block 12. The block 12 is formed with various passages and cavities described later on. In the drawing they are all shown in one plane, but in practice they will be distributed around the block 12 to lessen its bulk and diameter.

The block is formed with an inlet 13 connected to high pressure fluid acting in the direction of the arrow P and an outlet 14 connected to tank so that fluid can flow in the direction of the arrow T.

The inlet 13 is connected in the first place to a shuttle valve 15 of a well known type where it is applied at two positions 34 and 35. Secondly it leads to an annular space 16 around the front end of the piston 10 and to an accumulator 17.

The outlet 14 is connected in a well known manner to the front and back seals 18 and 19 of the machine, to the valve 15 at 36 and to a port 32 formed in the cylinder 12. Also in the cylinder is a large annular cavity 21 which at the back end of the machine leads to a rear cushion space 22. At the front the cavity 21 narrows into a front cushion space 23 and a front cylinder space 24.

The piston varies in diameter from back to front. At the back it has a diameter D1 which at an annular shoulder 25 changes to D2. At a stepped flange 26 the diameter increases first to D3 and then to D4. The front end of the flange 26 steps down to a diameter D5 and at an annular shoulder 27 the final diameter becomes D6. The piston also has a timing groove 20.

The relationships among areas related to some of these various diameters are important. Thus related areas D2–D1 must be larger than related areas D2–D6 so that with equal pressures acting on the resulting areas a power stroke can be achieved. In addition related areas D2 - D1 must also be larger than related areas D3–D6. Apart from the additional obvious requirements that D5 must be larger than D6 and D4 larger than D5, the diameters D5 and D4 can be chosen almost at will to suit the desired design characteristics of the machine.

The shuttle valve 15 is also connected at its right hand end 37 to a port 31. As shown the port 31 opens into the timing groove 20. On the opposite side a port 32 also opening into the timing groove 20 is connected to tank. As a result the valve 15 has now connected the space above the shoulder 25 to tank so that the return stroke can commence.

As the piston moves to the left the timing groove 20 uncovers a port 30 which is connected to the space 21 and also a port 33 which connects with the right hand end of the valve 12. Due to differential valve piston areas at 37 and 35 the valve 12 moves to the left to connect the space behind the shoulder 25 to pressure. The piston 10 then again moves to the right and as it accelerates the accumulator 17 discharges.

The improvement provided by the present invention mainly concerns the flange 26. Assume that the piston does not strike a tool stem so that travel to the right is not arrested by the tool. In such a case the piston keeps on going to the right under its acquired kinetic energy. The shoulder 27 enters the space 24 and the flange 26 enters the space 23 which is now closed at both ends except for such clearances as may be necessary or may be allowed due to design considerations. The flange 26 thus enters a cushion of hydraulic fluid. The groove 20 connects the cavity 21 to the port 32 so that the cavity is now relieved to tank. There is thus a cushion pressure of a high order to the front of the flange 26 and tank pressure at its rear. At the same time the piston area of the shoulder 27 is exposed to system pressure. The return stroke takes place smoothly without any stalling or cavitation.

Overtravel to the left is cushioned by the rear step of the flange 26 entering the space 22. In this case there is no need to vent the space 21 as the differential areas are sufficient to allow smooth operation.

During operation there is a sequential migration of fluid from the space 23 into the space 21, through the space 21, and then to tank. This serves to dissipate the heat generated by the cushioning action. It is contemplated that if this does not provide sufficient cooling, then additional cooling can be obtained by positioning the timing grooves and ports on the the piston and cylinder such that the spaces 23 and 21 and the groove 20 are open to each other for a predetermined time so that an increased volume of fluid will flow to the tank. This can be accomplished by arranging for the groove 20 to communicate with the chamber 21 as the flange 26 approaches the space 23.

I claim:

1. In a hydraulic percussive machine comprising a cylinder, a piston arranged to reciprocate in the cylinder to perform a power stroke and a return stroke, an inlet for liquid at high pressure, said piston having opposed work and return stroke pressure responsive areas disposed, respectively, in first and second cylinder chambers, an outlet for liquid at low pressure, a first space in the cylinder connected to the inlet, a cushioning flange on the piston which moves with substantial clearance in the first space, a second space of lesser diameter than the first space and leading from the first space and into which the flange can move to close the second space on overtravel of the piston during the power stroke to trap fluid into the second space so that a dashpot action takes place, the flange moving out of the second space during said return stroke, the improvement comprising an annular timing groove on the piston, timing ports in the cylinder, the timing groove and ports being so disposed as to connect the first space to the outlet when the flange is in the second space, thereby to facilitate the return stroke of the piston, means to disconnect the first space from inlet when the flange is in the second space, and said second space defining a cushioning chamber interposed between said cushioning flange and said first space disconnect means.

2. The machine claimed in claim 1, in which the cooperating timing groove and ports also connect the first space to the outlet when the cushioning flange approaches the second space.

3. The machine claimed in claim 1, in which the piston is provided with a shoulder on the forward end of the piston in relation to the cushioning flange to provide said return stroke area, the shoulder defining said first space disconnect means and closing the forward end of the second space and a port adapted to be connected to a source of liquid under pressure at the mouth of that end.

4. The machine claimed in claim 1, in which the rear of the cushioning flange is stepped to provide a shoulder and in which the cylinder is provided with a third space which the stepped portion can enter during overtravel on the return stroke.

* * * * *